US010264850B2

(12) United States Patent
Lam et al.

(10) Patent No.: US 10,264,850 B2
(45) Date of Patent: Apr. 23, 2019

(54) FLEXIBLE CUSHIONING DEVICE FOR SHOES AND METHODS OF PRODUCING THE SAME

(71) Applicant: Vocational Training Council, Wan Chai (HK)

(72) Inventors: Yee Nee Elita Lam, New Territories (HK); Kit Lun Yick, Kowloon (HK); Pui Lam Wong, Kowloon (HK); Sun Pui Ng, Kowloon (HK); Dad Ming Leung, Kowloon (HK)

(73) Assignee: Vocational Training Council, Hong Kong (HK)

( * ) Notice: Subject to any disclaimer, the term of this patent is extended or adjusted under 35 U.S.C. 154(b) by 513 days.

(21) Appl. No.: 14/623,475

(22) Filed: Feb. 16, 2015

(65) Prior Publication Data

US 2016/0235160 A1 Aug. 18, 2016

(51) Int. Cl.

| | |
|---|---|
| ***A43B 13/18*** | (2006.01) |
| ***A43B 13/38*** | (2006.01) |
| ***A43B 23/00*** | (2006.01) |
| ***A43B 17/02*** | (2006.01) |
| ***A43B 17/00*** | (2006.01) |
| ***A43B 3/00*** | (2006.01) |

(52) U.S. Cl.
CPC ..... *A43B 17/026* (2013.01); *A43B 3/0015* (2013.01); *A43B 17/006* (2013.01)

(58) Field of Classification Search
CPC ... A43B 3/0005; A43B 3/0015; A43B 1/0054; A43B 13/189; A43B 17/006; A43B 17/026; A43B 21/265; A61B 5/1036; A61B 5/1038
USPC ..... 36/1, 3 B, 25 R, 28, 43, 44; 12/142 N
See application file for complete search history.

(56) References Cited

U.S. PATENT DOCUMENTS

| | | | | |
|---|---|---|---|---|
| 4,471,538 A * | 9/1984 | Pomeranz | A43B 13/189 188/322.5 |
| 5,079,786 A * | 1/1992 | Rojas | A47C 7/021 5/654 |
| 5,155,927 A * | 10/1992 | Bates | A43B 13/189 36/114 |
| 5,601,164 A | 2/1997 | Ohsaki et al. | |
| 5,813,142 A * | 9/1998 | Demon | A43B 3/0005 36/28 |
| 5,906,767 A * | 5/1999 | Karol | H01F 1/447 252/62.51 R |

(Continued)

OTHER PUBLICATIONS

Barkema, D. D., Derrick, T. R., Martin, P. E. Heel height affects lower extremity frontal plane joint moments during walking, Gait Posture 2012; 35(3):483-488.

(Continued)

*Primary Examiner* — Jameson D Collier
(74) *Attorney, Agent, or Firm* — Eagle IP Limited; Jacqueline C. Lui

(57) ABSTRACT

A cushioning device for high heel shoes includes a layer of energy field generators producing electric/magnetic fields, and a chamber filled with an ER/MR fluid. The strengths of electric/magnetic fields are positioned in preassigned locations of the layer, according to the pressure distribution of foot. The viscosity of the ER/MR fluid can be adjusted by different strengths of electric/magnetic fields, so that different locations of foot can receive different supports from the cushioning device to enhance the comfort.

20 Claims, 11 Drawing Sheets

(56) References Cited

U.S. PATENT DOCUMENTS

| | | | | |
|---|---|---|---|---|
| 6,405,456 | B1 * | 6/2002 | Nichelson | A43B 1/0054 36/27 |
| 6,457,262 | B1 * | 10/2002 | Swigart | A43B 13/203 36/144 |
| 6,815,063 | B1 * | 11/2004 | Mayes | B82Y 25/00 252/62.52 |
| 7,200,956 | B1 | 4/2007 | Kotha et al. | |
| 7,219,449 | B1 * | 5/2007 | Hoffberg | A43B 1/0054 36/29 |
| 7,254,908 | B2 * | 8/2007 | Ungari | A43B 1/0054 36/29 |
| 7,694,440 | B1 * | 4/2010 | Wu | A43B 1/0054 36/28 |
| 8,468,722 | B2 | 6/2013 | Battlogg et al. | |
| 2004/0002665 | A1 * | 1/2004 | Parihar | A43B 3/0005 600/587 |
| 2004/0154190 | A1 * | 8/2004 | Munster | A43B 1/0054 36/28 |
| 2006/0248750 | A1 | 11/2006 | Rosenberg | |
| 2008/0155862 | A1 * | 7/2008 | Battlogg | A43B 5/0405 36/117.6 |
| 2009/0038180 | A1 * | 2/2009 | Jacob | A43B 1/0054 36/44 |
| 2010/0056846 | A1 * | 3/2010 | Friberg | A61N 2/06 600/9 |
| 2010/0251574 | A1 * | 10/2010 | Battlogg | A43B 5/0405 36/117.1 |
| 2012/0304500 | A1 * | 12/2012 | Bove | A43B 17/003 36/25 R |
| 2012/0317843 | A1 * | 12/2012 | Bove | A43B 1/0054 36/25 R |
| 2014/0250726 | A1 * | 9/2014 | Meschter | A43B 13/189 36/102 |
| 2015/0157091 | A1 * | 6/2015 | Hsu | A43B 13/40 36/44 |

OTHER PUBLICATIONS

Stefanyshyn, D.J., Nigg, B.M., Fisher, V., O'Flynn, B., Liu, W., 2000. The influence of high-heeled shoes on kinematics, kinetics and muscle EMG of normal female gait. Journal of Applied Biomechanics 16, 309-319.

Gefen, A., Megido-Ravid, M., Itzchak, Y., Arcan, M., 2002. Analysis of muscular fatigue and foot stability during high-heeled gait. Gait Posture 15, 56-63.

Ebbeling, C.J., Hamill, J., Crussemeyer, J.A., 1994. Lower extremity mechanics and energy cost of walking in high-heeled shoes. Journal of Orthopaedic & Sports Physical Therapy 19, 190-196.

Cong, Y., Cheung, J.T., Leung, A.K., Zhang, M., 2011. Effect of heel height on in-shoe localized triaxial stresses. Journal of Biomechanics 44, 2267-2272.

Simonsen, E.B., Svendsen, M.B., Nørreslet, A., Baldvinsson, H.K., Heilskov-Hansen, T., Larsen, P.K., Alkjær, T., Henriksen, M., 2012. Walking on high heels changes muscle activity and the dynamics of human walking significantly. Journal of Applied Biomechanics 28, 20-28.

Bus SA, Ulbrecht JS, Cavanagh PR, Pressure relief and load redistribution by custom-made insoles in diabetic patients with neuropathy and foot deformity, Clin Biomech 19:629-638, 2004.

Goske S, Erdemir A, Petre M, Budhabhatti S, Cavanagh PR, Reduction of plantar heel pressures: insole design using finite element analysis, J Biomech 39:2363-2370, 2006.

Cheung JTM, Zhang M, Parametric design of pressure-relieving foot orthotic using statistics-based finite element method, Med Eng Phys 30:269-277, 2008.

Wang X and Gordaninejad F, (2008). Magnetorheological materials and their applications: a review, Intelligent materials (Cambridge: Royal Society of Chemistry), pp. 339-385.

Olabi A G and Grunwald A, (2007). Design and application of magneto-rheological fluid, Mater. Des. 28 2658-64.

De Vicente J, Klingenberg D J and Hidalgo-Alvarez R, (2011). Magnetorheological fluids: a review, Soft Matter, 7 3701-10.

Zhang X Z, Li W H and Gong X L, (2010). Thixotropy of MR shear-thickening fluids, Smart Mater. Struct., 19 125012.

T. Pranoto, K. Nagaya, (2005). Development on 2DOF-type and Rotary-type shock absorber damper using MRF and their efficiencies, Journal of Materials Processing Technology, 161, 146-150.

Forte, P., Patern,O' .M. and Rustighi, E. (2004). "A Magnetorheological Fluid Damper for Rotor Applications," Int. J. Rotating Mach., 10:175_182.

Kim, K.J., Lee, C.W. and Koo, J.H. (2008). "Design and Modeling of Semi-active Squeeze Film Damper using Magnetorheological Fluid," Smart Mater. Struct., 17:1_12. DOI: 10.1088/0964-1726/17/3/035006.

Stanway, R., Sproston, J.L., and El-Wahed, A.K., (1995). Applications of electro-rheological fluids in vibration control: a survey, Smart Mater. Struct. 5, 196, pp. 464-482.

Stanway R, (2003). Smart fluids: current and future developments, Department of Mechanical Engineering, The University of Sheffield, Mappin Street, Sheffield S1 3JD, UK.

Li J X et. al. (2010). Giant electrorheological fluid comprising nanoparticles: Carbon nanotube composite, Journal of Applied Physics 107, 093507 (2010); doi: 10.1063/1.3407503.

Wen W et. al., (2007). Electrorheological fluids: structures and mechanisms, Soft Matter, DOI: 10.1039/b710948m.

Lee H G et. al., (2001). Dynamic properties of an ER fluid under shear and flow Modes, Materials and Design 23 Ž2002. 69_76.

Tam W Y et. al., (1997). New Electrorheological Fluid: Theory and Experiment, Physical Review Letters, vol. 78, No. 15.

Zhao H P et. al., (2000). Mechanical properties of a new electrorheological fluid, Solid State Communications 116 (2000) 321-325.

Dassanayake U et. al, (1999). Structure of electrorheological fluids, Journal of Chemical Physics 112, No. 8.

Zhang K, et. al., (2013). Generalized yield stress equation for electrorheological fluids, Journal of Colloid and Interface Science 409 (2013) 259-263.

Meng Y G et. al., (2005). Unidirectional compression of electrorheological fluids in electric fields, J. Appl. Phys. 98, 074901 (2005); doi: 10.1063/1.2064310.

* cited by examiner

FLEXIBLE CUSHIONING DEVICE FOR SHOES AND METHODS OF PRODUCING THE SAME

FIELD OF INVENTION

This invention relates to a cushioning device. In particular, the invention relates to a shoe insole.

BACKGROUND OF INVENTION

Despite health hazard warnings, studies have indicated that the wearing of high-heeled shoes is a widespread behavior pattern among women. Common foot problems such as callus, plantar forefoot pain, and metatarsal stress fracture were often suffered by women who wear high-heeled shoes. Different studies showed that the plantar pressure distributions are greatly influenced by the increase in heel heights. During walking, high-heeled shoes increased ankle plantar flexion angle, changed muscle activity, reduced gait stability, increased forefoot pressure and possibly increased the risk of knee injuries.

Shoe inserts (removable insole) are commonly used for redistributing the plantar pressure so as to enhance the comfort when wearing shoes. The existing high-heeled shoe inserts are usually made of soft material, e.g. DR. SCHOLL'S° DREAMWALK™ gel inserts, FOOT PETALS® high-heeled shoe insole cushions and INSOLIA® high-heeled shoe insert. These inserts are made with fixed properties, e.g. thickness, shape and hardness. These fixed properties are critical factors of the comfort for the wearer. However, the settings of the existing insert design (i.e. shape and hardness) available in the market are fixed and it may not suitable for everyone or suit different purposes. The level of plantar pressure varies depending on wearer's foot measurement, heel heights and walking condition. Due to the limitation of flexibility, wearers could not adjust the property of inserts for their most desirable comfort condition.

There are various studies on the development of smart insole for footwear, but only few of them were focusing on the insole design for ladies' high-heeled shoes. In the present researches about smart insole for footwear, sensors, which integrated with circuit and electrical power supply, are included to achieve the smart functions. In these designs, sensors are used to determine the plantar pressure distribution and comfort level of the users. Based on the condition, the integrated circuit including sensors changes the property (i.e. shape and hardness) of the smart insole.

SUMMARY OF INVENTION

It is therefore an objective of the present invention to provide an alternative smart cushioning device.

Accordingly, in one aspect, the present invention provides a cushioning device which includes a layer and a chamber filled with field responsive fluid. The layer includes energy field generators, which produce energy fields in a plurality of preassigned locations within the layer. The strength of the field in each preassigned location is pre-set according to a user's requirements and may vary between locations. The viscosity of the fluid can be adjusted by the fields such that the viscosity at one location in the chamber may be different from another location.

In an embodiment of the present invention, the energy field generators include power source and electrodes to generate electric fields upon the fluid and the fluid is electrorheological fluid.

In an embodiment of the present invention, the chamber may comprise at least one tunnel. The electrodes are coupled to two sides of the tunnel, so that the viscosity of the fluid can be adjusted by the electric field of the tunnel.

In another embodiment of the present invention, the energy field generators are magnets. The magnets are distributed in a plurality of preassigned locations within the layer. The strength of the magnetic field of the magnets in each preassigned location is pre-set according to the user's requirements and may vary between locations, and the field responsive fluid is magnetorheological fluid.

In another embodiment of the present invention, the chamber is positioned between a body portion of a user and the layer during use.

In another embodiment of the present invention, the magnetorheological fluid includes ferromagnetic particles suspended in an organic or aqueous carrier liquid.

In an embodiment of the present invention, the strength of the energy field is pre-set by measuring pressure distribution generated by different locations within a part of the body of the user.

In a further embodiment of the present invention, the strength is pre-set by pressure distribution of a foot measured by pedar pressure measuring system.

In further embodiment of the present invention, the layer may be divided into multiple sub-layers and the strength of the field in one sub-layer may vary from another sub-layer.

In another embodiment of the present invention, the strength of the field is pre-set by the 3D foot anthropometry data, plantar pressure evaluation, locations of foot pain, gait postures or geometry of anatomical zones of the user.

In a specific embodiment of the present invention, the cushioning device is an insole for high-heeled shoes.

In a further embodiment of the present invention, the cushioning device further includes a conforming arch contour.

In another aspect, the present invention provides a layer for varying the density of a cushioning device including a substrate and magnets disposed in or on the substrate. The magnets are distributed in a plurality of preassigned locations within the substrate. The strength of the magnetic field of the magnets in each preassigned location is pre-set according to the user's requirements and may vary between locations.

In a further aspect, the present invention provides a method of preparing a cushioning device for cushioning a part of the body of a user, which includes the following steps: i. determining pressure distribution generated by different locations of the part of the body; ii. positioning energy field generators which produce different field strengths, and the strengths are proportional to the pressure distribution of the different locations; and iii. coupling a packet of a field responsive fluid with the energy field generators. In this method, the viscosity of the fluid can be adjusted by the fields such that different locations of the part of the body will receive different supports from the cushioning device during use.

In an embodiment of the present invention, the energy field generators are magnets and the field responsive fluid is magnetorheological fluid.

In another embodiment of the present invention, the energy field generators produce electric fields and the field responsive fluid is electrorheological fluid.

Compared with traditional cushioning devices, the cushioning device of the present invention shows many advantages of safety and energy. For example, the pressure zones more specifically and more effectively so as to maximize the comfort of wearing high-heeled shoes by adjusting the location and size of the smart fluids insert cushioning; custom-made modular insert design suitable for anyone and any condition (e.g. different heel height, comfort level and health condition).

DETAILED DESCRIPTION OF THE PREFERRED EMBODIMENTS

As used herein and in the claims, "comprising" means including the following elements but not excluding others.

The term used herein "footwear" or "shoe" broadly includes all types of footwear including but not limited to slippers, sandals, high heel shoes, and casual, sports, dress shoes, and man shoes, and woman shoes, etc.

The term used herein "electrorheological (ER) fluid" refers to any fluid which can respond to an electric field and the viscosity of which can be adjusted by the strength of the electric field.

The term used herein "magnetorheological (MR) fluid" refers to any fluid which can respond to magnets and the viscosity of which can be adjusted by the strength of the magnetic field.

Figure 1:
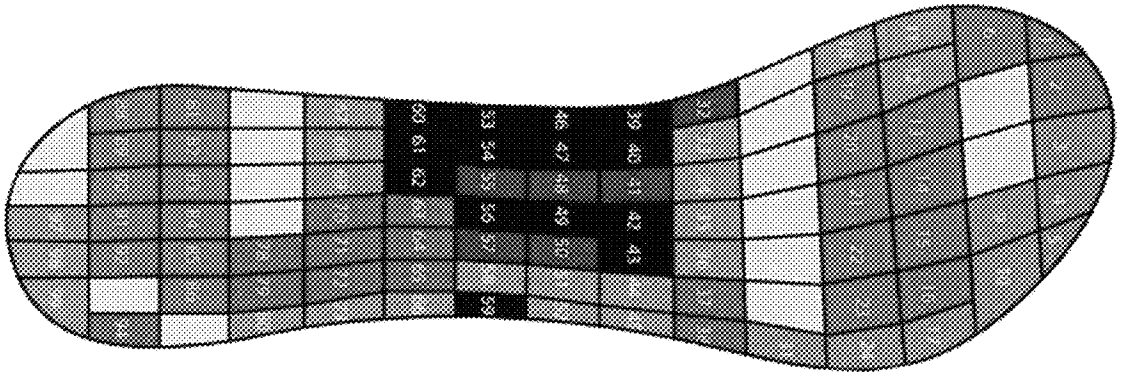
FIG. 1 shows pressure distribution of a foot evaluated by Pedar pressure measuring system according to one embodiment of the present invention.

Referring to FIG. 1, an embodiment of the present invention illustrates the pressure distribution of plantar surface of a foot based on Pedar pressure measuring system. Pressures exhibit different distributions due to different people, different heel heights, and different foot conditions, etc. The invention provides a "custom-made" solution for a cushioning device of shoes.

Figure 2:
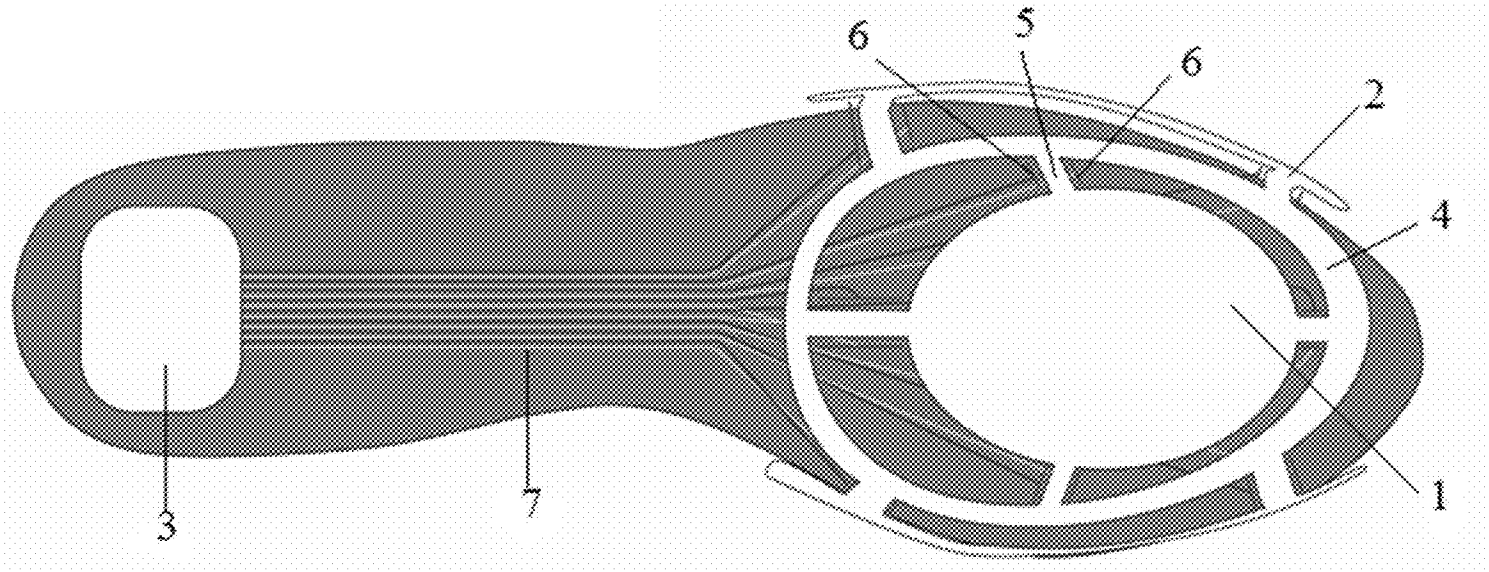
FIG. 2 shows a chamber of ER fluid with tunnels connecting to power source.
Figure 3:
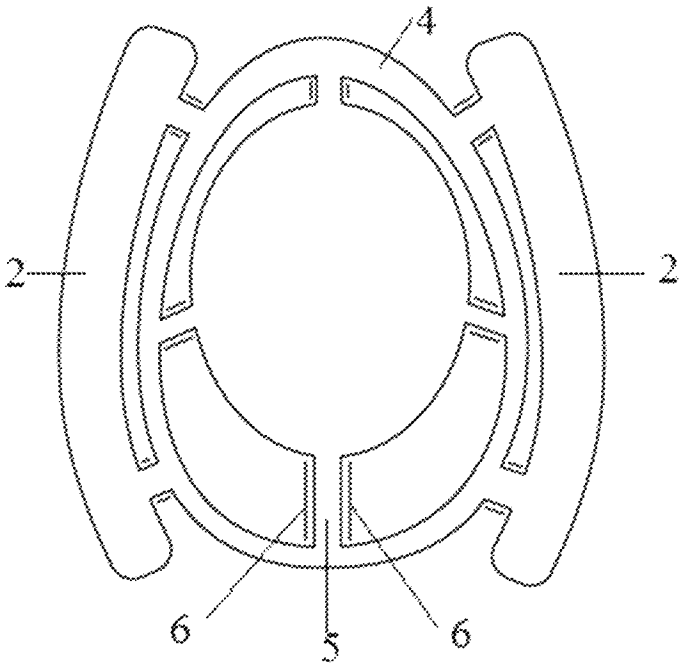
FIG. 3 shows a partial view for the forefoot and lateral side areas of the insole of the embodiment of FIG. 2.

In one embodiment, FIG. 2 illustrates a shoe insole for forefoot area (1) and lateral side area (2). A power source (3) is positioned at the hindfoot area, and the forefoot and lateral side areas are supported by a chamber filled with ER fluid (4). The chamber has multiple tunnels (5), and copper slices (6) as electrodes are coupled to the left and right sides of the tunnels. The copper slices, are connected to the power source (3) by wires (7). FIG. 3 shows the forefoot and lateral side areas of FIG. 2. The electrodes and power source provide electric fields upon the ER fluid. The viscosity of the fluid can be adjusted by different strengths of electric fields, such that the fluid can provide different supports for regions of foot. The positions of tunnels can be preassigned. The strengths of electric fields in the different locations can be pre-set according to the user's requirements, such as being proportional to the pressure distribution generated by the corresponding regions of the foot, as shown in FIG. 1.

Figure 4:
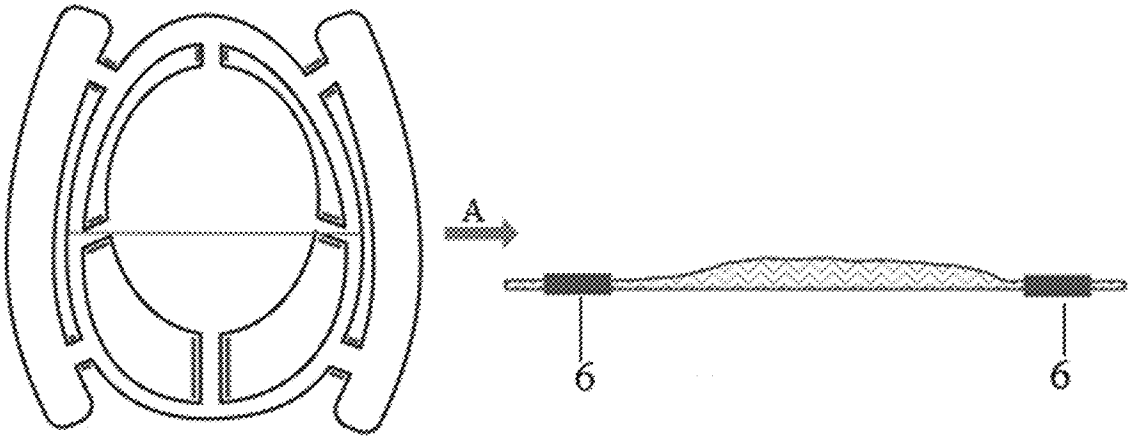
FIG. 4 shows a cross view for the shape of fluid from the direction of A.

The reaction between the ER fluid and the electric fields can achieve a flow management property and control the amount and direction of the fluid flow, to create a contour stiffness and shape for a user, which is controllable by the strengths of power. FIG. 4 shows a cross view for the shape of fluid from the direction of A under the effects of two external stimulus fields (6). External stimulus fields act as a valve to control the flow of the fluid. The higher the strength of electric field, the higher the viscosity of the fluid and the more support for the wearer.

Figure 5:
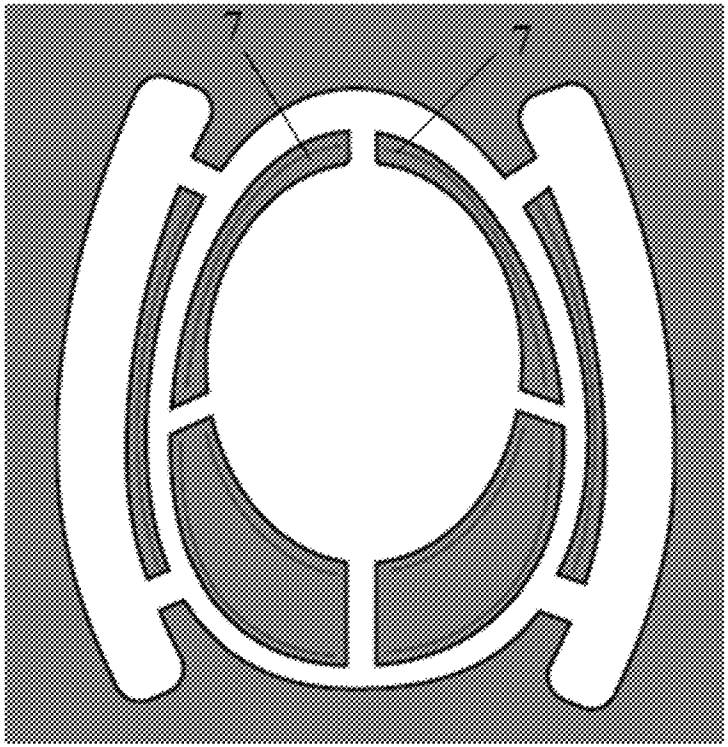
FIG. 5 shows an arrangement for metal slices at the forefoot area and lateral side areas.

The electric fields can be provided by different means of positioning metal slices (electrodes) and connecting the slices to power source, such that the positions and strengths of fields can be preassigned and pre-set according to the user's demand. FIG. 5 shows a different arrangement for metal slices (7) at the forefoot area. Electric fields with various strengths may be generated by connecting different electrodes with power source.

Figure 6:
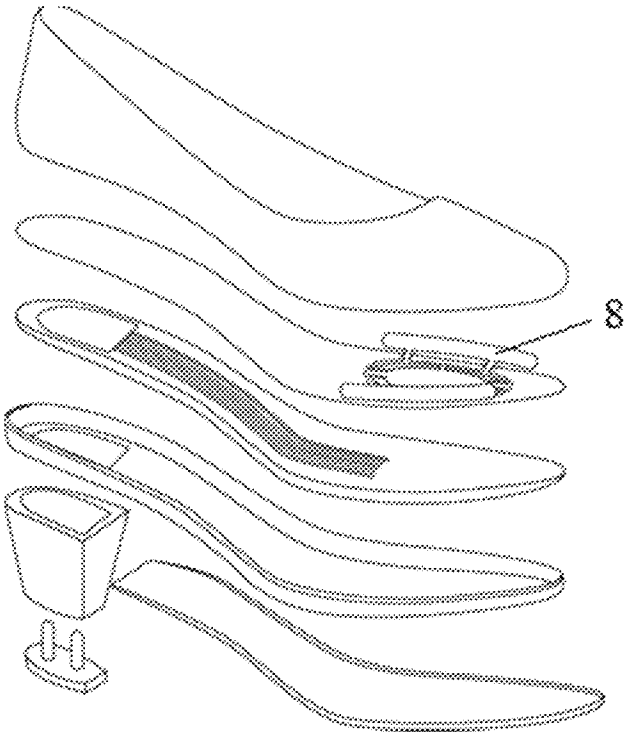
FIG. 6 shows a high heel shoe with the insert for the forefoot and lateral side areas including the chamber of ER fluid.

FIG. 6 illustrates a high heel shoe with the insert for the forefoot and lateral side areas including the chamber of ER fluid (8) and electrical power with wires connected to the tunnels. The pressure distribution of regions of foot on shoe may vary due to the change of the height of the heel. The support distributions of the insert for the user's foot can be set by adjusting the distribution and strengths of the electric fields, so that the kind of insert suits the shoes with any heel height.

Figure 7A:
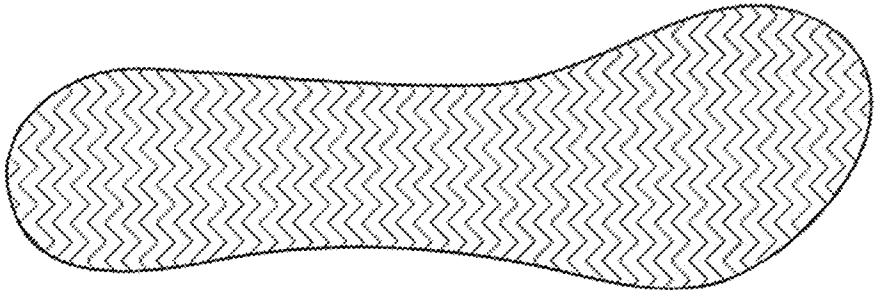
FIG. 7(*a*) shows a chamber of MR fluid, and FIG. 7(*b*) shows a layer filled with magnets according to one embodiment of the present invention.
Figure 7B:
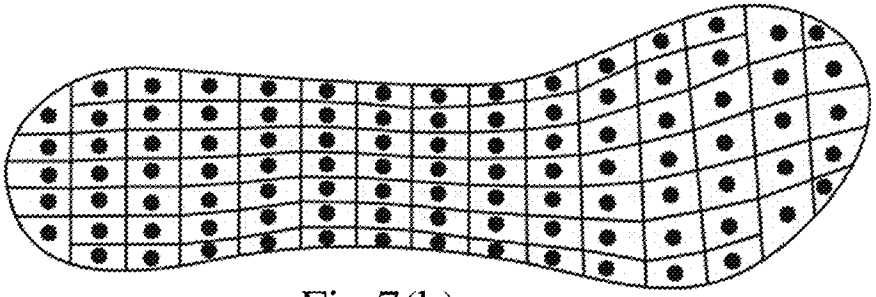

In another embodiment, FIG. 7(*a*) illustrates a chamber of MR fluid whose viscosity can be adjusted by magnetic fields of magnets, so that the fluid can provide different supports for foot by changing the strengths of magnetic fields. MR fluid mainly consists of micron-sized ferromagnetic or ferromagnetic particles suspended in an organic or aqueous carrier liquid. There are many different ceramic, metal and alloy compositions which have been described and can be used to prepare MR fluids. FIG. 7(*b*) illustrates a layer comprising magnets for the cushioning device of shoe. Multiple locations are preassigned within the layer, which may correspond to the regions of plantar pressure of the foot as shown in FIG. 1.

Figure 8A:
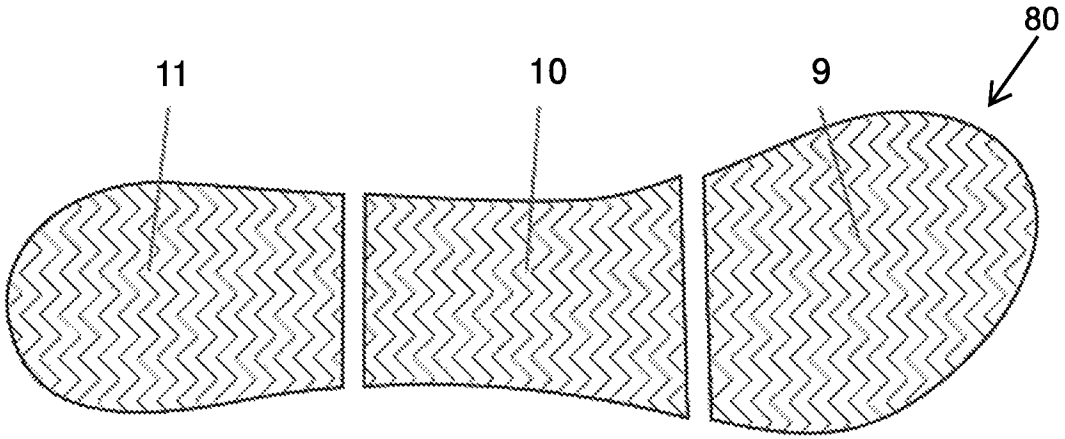
FIG. 8(*a*) shows a chamber of MR fluid with three divided sections, and FIG. 8(*b*) shows a layer filled with magnets with three divided sections according to another embodiment of the present invention.
Figure 8B:
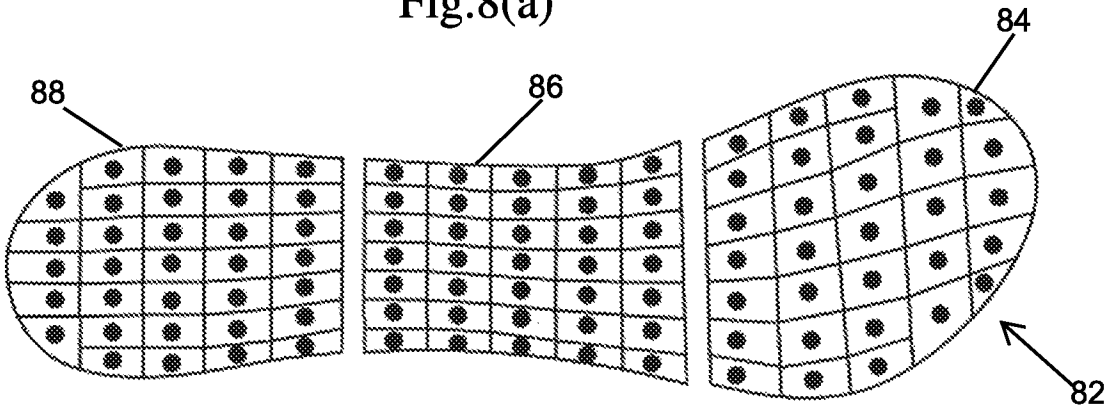

In a further embodiment, FIG. 8(*a*) and FIG. 8(*b*) illustrate another design of the chamber (80) and layer (82) of the cushioning device. The chamber (80) (FIG. 8(*a*)) can be divided into the front section (9), middle section (10) and heel section (11). The layer (82) (FIG. 8(*b*)) is also divided into these three sections (84), (86) and (88) accordingly.

According to the value of pressure distribution of the foot, magnets with different strengths of magnetic fields are arranged within the layer. The strengths of magnets in the locations of the layer are pre-set to be proportional to the pressure distribution generated by the corresponding regions of the foot.

Figure 9:
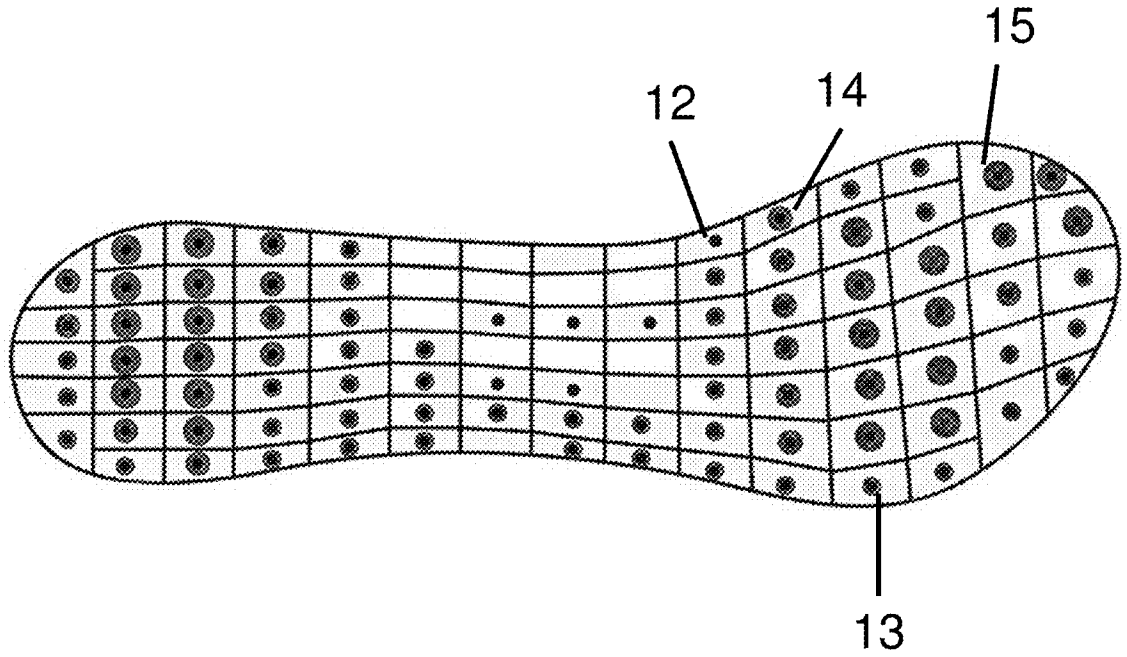
FIG. 9 shows the arrangement of magnets with different strengths of magnetic fields in the layer according to the same embodiment of FIG. 1.
Figure 10:
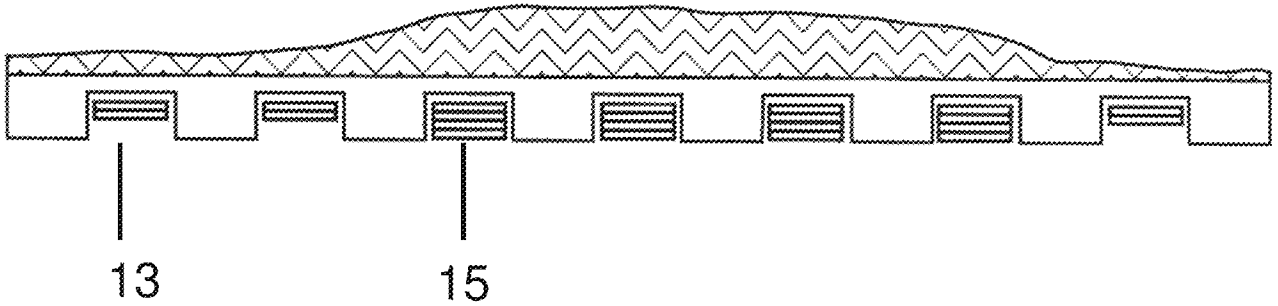
FIG. 10 shows the cross view of insert according to the same embodiment of FIG. 9.

In an embodiment, as shown in FIG. 9, magnets with different strengths are positioned in the locations of the layer, based on the plantar pressure distribution of FIG. 1. In FIG. 9, a solid round 12 (●) refers to a piece of modular magnet disc with 1 mm of thickness (corresponding to grids 32, 41, 48, 50, 55 and 57 of FIG. 1); a solid round with a circle surrounding 13 (●) refers to two pieces of such magnet discs arranged in the locations of the layer (corresponding to grids 3-5, 9-12, 17-18, 24, 31, 33-36, 44-45, 51-52, 58, 66-69, 73, 80 and 97-99 of FIG. 1); a solid round with two circles surrounding 14 (◉) refers to three pieces of such magnet discs arranged (corresponding to grids 7-8, 25-30, 74-77, 87, 93 and 95-96 of FIG. 1); a solid round with three circles surrounding 15 (◉) refers to four pieces of such magnet discs arranged (corresponding to grids 1-2, 6, 13-16, 19-23, 81-86 and 88-92 of FIG. 1). The cross view of the row of grids 11-17 is shown as FIG. 10. The higher the magnetic level, the higher the viscosity of the fluid and the more support for the wearer.

In another embodiment, the magnets are magnetic dics with 0.2-2 mm thickness.

Figure 11:
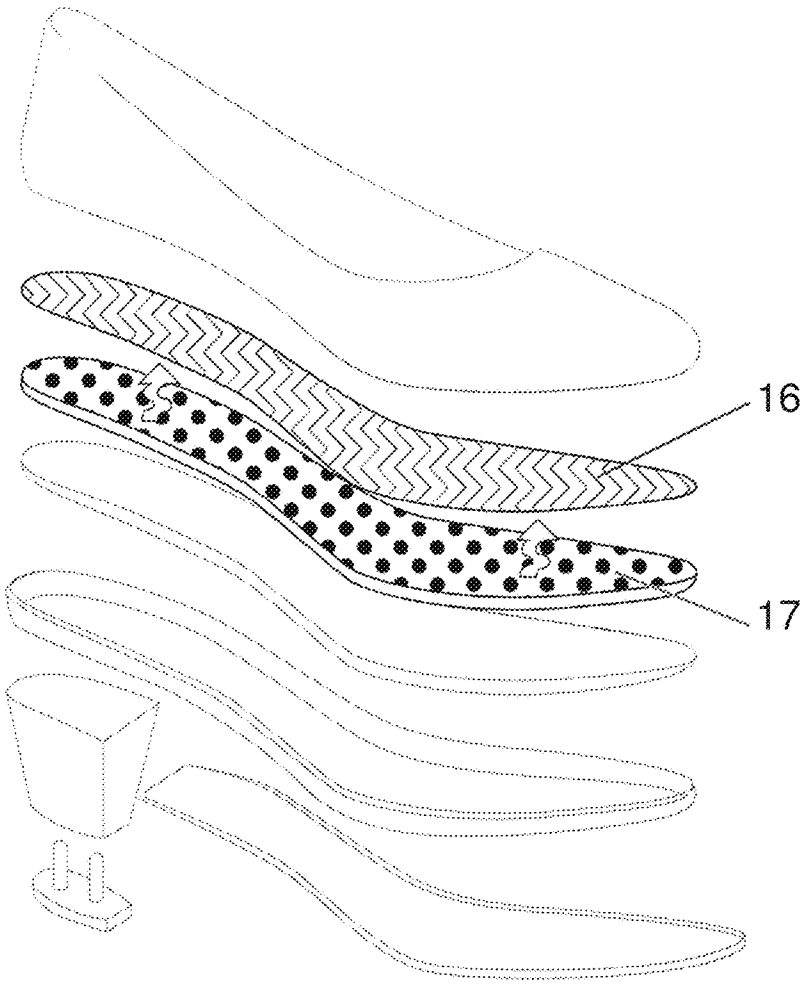
FIG. 11 shows a high heel shoe with a chamber of MR fluid and a layer filled with magnets.

FIG. 11 illustrates a high heel shoe with the insert including the chamber of MR fluid (16) and the layer of magnets (17). The chamber (16) is coupled with the layer (17) underneath.

The smart material used in the invention can be field responsive fluid including ER or MR fluid. Field responsive fluid including ER/MR fluid mainly consists of polarized or ferromagnetic particles suspended in insulating fluid. There are many different ceramic, metal and alloy compositions have been described and can be used to prepare the field responsive fluid including ER/MR fluid.

Since the external stimulus field increases the viscosity of field responsive fluid including ER/MR fluid in particular area, the density of the filed responsive fluid would be increased. Field responsive fluid including ER/MR fluid would change from a liquid state to a semi-solid state within few milliseconds. Once the field is removed, the viscosity of field responsive fluid including ER/MR fluid returns to normal range and it turns back to liquid form. The viscosity changes response rapidly (within a few milliseconds) and nearly completely reversible. Therefore, both the dimension properties (i.e. thickness and shape) and the material properties (i.e. viscosity, density, and strength) are flexible and adjustable in any part of the insert. By controlling the distribution of external stimulus field, the insert can be changed to different purpose of usage. The liquid form of field responsive fluid including ER/MR fluid also provides the best matching for different footwear as well as different shape of feet.

With reference to the plantar pressure and comfort of wearer under different heel heights, by analyzing the 3D foot anthropometry data, plantar pressure evaluation, locations of foot pain, gait postures and/or geometry of anatomical zones, the most suitable electric/magnetic field level can be identified and can be pre-set in the layer. By controlling the distribution of electric/magnetic fields, the cushioning device can be changed to suit different purposes of usage.

For the material property, the yield stress of the field responsive fluid including ER/MR fluid would increase with viscosity to provide supporting force. The invention utilizes the semi-solid bonding of the fluid to fabricate a shock absorbing smart insert with variable shape, thickness, hardness and material properties for different customers' demand by adjusting the strengths of electric/magnetic fields.

The chamber of field responsive fluid including ER/MR fluid may be made of durable elastic material, which the thickness of the chamber will change correspondingly to the viscosity of the field responsive fluid including ER/MR fluid and provides cushioning effects of the wearer's foot.

The insert may further include extra support, such as a conforming arch contour, which will redistribute plantar pressure from the forefoot to other underfoot regions, and improves the interfacial contact between the insert surface and foot arch, as well as enhances the overall comfort of the footwear.

The exemplary embodiments of the present invention are thus fully described. Although the description referred to particular embodiments, it will be clear to one skilled in the art that the present invention may be practiced with variations of these specific details. Hence this invention should not be construed as limited to the embodiments set forth herein.

For example, the magnets used in the invention can be modular magnets, or permanent magnet, etc.

For example, the power source can be arranged in different locations of the insert, besides at the hindfoot area. The chamber of field responsive fluid including ER/MR fluid can be also set at the midfoot area, the hindfoot area or even the full foot area.

For example, any meta slices can serve as electrodes to provide electric fields, such as copper, ferrum, aluminium, zinc, etc.

While a shoe insert is used as an illustrative example in this specification, it is clear that cushioning devices for other parts of the body can also be designed based on the invention principle disclosed in this specification, such as a electric/magnetic mattress based on pressure distribution of the body of a user, a electric/magnetic cushion for a seat or chair based on pressure distribution of the buttock or back of a user, and so on.

What is claimed is:

1. A method of preparing a cushioning device that is an insole of a shoe, the method comprising:

providing a chamber that has a shape of the insole, and is divided into a front section of the chamber that is configured to fit underneath a front section of a sole of a foot, a middle section of the chamber that is configured to fit underneath a middle section of the sole of the foot, and a heel section of the chamber that is configured to fit underneath a heel section of the sole of the foot, each of the front section of the chamber, the middle section of the chamber and the heel section of the chamber being filled with magnetorheological (MR) fluid; and providing a layer that has the shape of the insole and fits underneath the chamber to form the insole of the shoe, and that is divided into a front section of the layer that fits underneath the front section of the chamber, a middle section of the layer that fits underneath the middle section of the chamber and a heel section of the layer that fits underneath the heel section of the chamber, each section of the layer including a plurality of magnetic discs arranged in a plurality of grids in the layer, the plurality of grids extending throughout the layer, wherein the layer has a higher number of magnetic discs in grids that are configured to receive higher pressure from the sole of the foot and a lower number of magnetic discs in grids that are configured to receive lower pressure from the sole of the foot.

2. The method of claim 1 further comprising:

determining a pressure distribution of the sole of the foot against the insole of the shoe; and setting the number of the magnetic discs in each of the plurality of grids that extend throughout the layer according to the pressure distribution of the sole of the foot against the insole, such that the higher number of magnetic discs is arranged at one of the plurality of grids of the higher pressure and the lower number of magnetic discs is arranged in another of the plurality of grids of lower pressure.

3. The method of claim 2 further comprising:

numbering the plurality of the grids that extend throughout the layer such that different numbers of the magnetic discs are arranged into each of the plurality of the grids according to the pressure distribution of the sole of the foot against the insole.

4. The method of claim 2, wherein the layer has the same shape and size as the chamber such that the chamber and the layer that fits underneath the chamber are aligned to form the insole, the MR fluid of the chamber is configured to support the entire sole of the foot, and support is varied by positioning different numbers of the magnetic discs into each of the plurality of grids that extend throughout the layer.

5. The method of claim 1, wherein each of the magnetic discs has a thickness of 0.2-2 millimeters (mm).

6. The method of claim 1, wherein 1-4 of the magnetic discs are arranged in grids that include the magnetic discs, and each of the magnetic discs has a thickness of 1 mm.

7. The method of claim 1, wherein each of the front section of the layer and the heel section of the layer has a higher number of the magnetic discs than the middle section of the layer.

8. A method of preparing a cushioning device that is an insole of a shoe, the method comprising:

providing a chamber that has a shape of the insole, is configured to fit underneath a sole of a foot, and is divided into a front section of the chamber, a middle section of the chamber, and a heel section of the chamber, each of the front section of the chamber, the middle section of the chamber and the heel section of the chamber being filled with magnetorheological (MR) fluid, the MR fluid in the front section of the chamber, the middle section of the chamber and the heel section of the chamber being divided from each other; and providing a layer that has the shape of the insole, and is divided into a front section of the layer that fits underneath the front section of the chamber, a middle section of the layer that fits underneath the middle section of the chamber, and a heel section of the layer that fits underneath the heel section of the chamber, the layer having a plurality of grids that extend throughout the layer and including a plurality of permanent magnets arranged in the plurality of grids of the layer, wherein the layer has a higher number of the permanent magnets in grids that are configured to receive higher pressure from the sole of the foot and a lower number of the permanent magnets in grids that are configured to receive lower pressure from the sole of the foot, the higher number of the permanent magnets produces a stronger magnetic field than the lower number of the permanent magnets does, and a viscosity of the MR fluid of the chamber is varied by positioning different number of the permanent magnets in the layer underneath the chamber.

9. The method of claim 8 further comprising:

determining a pressure distribution of the sole of the foot against the insole of the shoe; and setting the number of the permanent magnets in each of the plurality of grids that extend throughout the layer according to the pressure distribution of the sole of the foot against the insole such that the higher number of permanent magnets is arranged in one of the plurality of grids of higher pressure and the lower number of permanent magnets is arranged in another of the plurality of grids of lower pressure.

10. The method of claim 9 further comprising:

numbering the plurality of the grids that extend throughout the layer such that different numbers of the permanent magnets are arranged into each of the plurality of the grids according to the pressure distribution of the sole of the foot against the insole.

11. The method of claim 8, wherein the layer has the same shape and size as the chamber such that the chamber and the layer that fits underneath the chamber are aligned to form the insole, the MR fluid of the chamber is configured to support the entire sole of the foot, and support is varied by positioning different numbers of the permanent magnets into each of the plurality of grids that extend throughout the layer.

12. The method of claim 8, wherein each of the permanent magnets is a magnetic disc with a thickness of 0.2-2 millimeters (mm).

13. The method of claim 12, wherein 1-4 of the magnetic discs are arranged in grids that include the magnetic discs, and each of the magnetic discs has a thickness of 1 mm.

14. The method of claim 8, wherein each of the front section of the layer and the heel section of the layer has a larger number of the permanent magnets than the middle section of the layer.

15. A method of preparing a cushioning device that is an insole for a high heel shoe, the method comprising:

providing a chamber that is filled with magnetorheological (MR) fluid and is divided into a front section of the chamber that is configured to fit underneath a front section of a sole of a foot, a middle section of the chamber that is configured to fit underneath a middle section of the sole of the foot, and a heel section of the chamber that is configured to fit underneath a heel section of the sole of the foot, the MR fluid in the front section of the chamber, the middle section of the chamber and the heel section of the chamber being divided from each other;

providing a layer that has a shape of the insole of the high heel shoe, and is divided into a front section of the layer that fits underneath the front section of the chamber, a middle section of the layer that fits underneath the middle section of the chamber, and a heel section of the layer that fits underneath the middle section of the chamber; and providing a plurality of permanent magnetic discs arranged in a plurality of grids of the layer, the plurality of grids extending throughout the layer, wherein a larger number of the permanent magnetic discs is positioned in one of the plurality of grids that is configured to receive higher pressure from the sole of the foot, a smaller number of the permanent magnetic discs is positioned in another of the plurality of grids that is configured to receive lower pressure from the sole of the foot, such that the larger number of the permanent magnetic discs produces a stronger magnetic field than the smaller number of the permanent magnetic discs.

16. The method of claim 15 further comprising:

determining a pressure distribution of the sole of the foot against the insole of the high heel shoe; and setting the number of the permanent magnetic discs in each of the plurality of grids that extend throughout the layer according to the pressure distribution of the sole of the foot against the insole such that the larger number of permanent magnetic discs is arranged in the one of the plurality of grids of higher pressure and the smaller number of permanent magnetic discs is arranged in the another of the plurality of grids of lower pressure.

17. The method of claim 16 further comprising:

numbering the plurality of the grids that extend throughout the layer such that different numbers of the permanent magnetic discs are arranged into each of the plurality of the grids according to the pressure distribution of the sole of the foot against the insole.

18. The method of claim 15, wherein the layer has the same shape and size as the chamber such that the chamber and the layer that fits underneath the chamber are aligned to form the insole, the MR fluid of the chamber is configured to support the entire sole of the foot, and support is varied by positioning different numbers of the permanent magnetic discs into each of the plurality of grids that extend throughout the layer.

19. The method of claim 15, wherein each of the permanent magnetic discs has a thickness of 0.2-2 millimeters (mm).

20. The method of claim 15, wherein 1-4 of the permanent magnetic discs are arranged in grids that include the permanent magnetic discs, and each of the permanent magnetic discs has a thickness of 1 mm.

* * * * *